US005303923A

United States Patent [19]

Garcia

[11] Patent Number: 5,303,923

[45] Date of Patent: Apr. 19, 1994

[54] GOLF PUTTER

[75] Inventor: Larry Garcia, Oldsmar, Fla.

[73] Assignee: Convex, Inc., Oldsmar, Fla.

[21] Appl. No.: 933,784

[22] Filed: Aug. 24, 1992

[51] Int. Cl.[5] ..... A63B 53/04

[52] U.S. Cl. ..... 273/175; 273/167 C; 273/167 B

[58] Field of Search ..... 273/175, 167 C, 167 B, 273/164.2, 167 A, 167 D, 167 F, 167 H, 167 J, 167 K

[56] References Cited

U.S. PATENT DOCUMENTS

| | | | |
|---|---|---|---|
| 656,099 | 8/1900 | Dunn | 273/175 |
| 1,511,479 | 10/1924 | Kelly et al. | 273/175 |
| 1,525,137 | 2/1925 | Lawton | 273/167 C |
| 3,394,937 | 7/1968 | Allport | 273/167 B |
| 3,989,257 | 11/1976 | Barr | 273/175 |
| 4,881,739 | 11/1989 | Garcia | 273/164 |
| 4,902,015 | 2/1990 | Nebbia | 273/167 B X |
| 5,207,721 | 5/1993 | Lobdell | 273/167 C |

*Primary Examiner*—George J. Marlo
*Attorney, Agent, or Firm*—David Kiewit

[57] ABSTRACT

A golf putter is optimized by providing a cylindrical ball-striking face with a radius of curvature of between about 2 and about 6 inches. The ball-striking face of the preferred putter is arcuate in cross-section and has a radius of curvature of essentially 4 inches about a horizontal axis lying in a plane parallel to and spaced essentially 0.84 inches from the sole of the putter. This shape for the putting face ensures that a ball will be stroked with a desirable over-spin. The putter also retains much of a conventional flat-faced putter's immunity to small variations that a golfer may make about an ideal stroking position.

4 Claims, 4 Drawing Sheets

GOLF PUTTER

BACKGROUND OF THE INVENTION

The present invention provides an improved golf putter that imparts a desireable over-spin to a putted ball even if the head of the putter is in a non-ideal orientation. An earlier putter designed to provide over-spin also tended to produce less than optimum results when held in an improper orientation.

In an earlier patent (U.S. Pat. No. 4,881,739) that addresses the same general subject matter, the inventor provided a detailed discussion of the extensive prior art of putter design and taught a putter with a cylindrical facing having a radius equal to that of a golf ball (0.84 inch), and made so that the face had its most forwardly projecting point elevated from the sole of the club by a height substantially equal to that radius. This design ensures that a putted ball is always contacted at or above its center of gravity. Contacting the ball above its center of gravity provides the ball with a desireable over-spin. The disclosure of U.S. Pat. No. 4,881,739 is incorporated herein by reference.

The putter design taught in U.S. Pat. No. 4,881,739 was based on an idealized geometry—i.e. one in which the axis of the putter head is parallel to the putting surface and the bottom of the putter is only slightly elevated above that surface. Extensive tests on the putter of U.S. Pat. No. 4,881,739 indicated that deviations from this ideal geometry led to poor results more quickly than did comparable deviations when putting with a conventional flat-faced putter. This particularly affected golfers who had trained themselves to putt with either the heel or toe of the putter slightly elevated.

Some known putter designs attempt to compensate for small deviations from ideality in the stroke geometry. Among these are designs that employ concave impact surfaces and that are forbidden by the Rules of Golf. The teaching of the present invention is entirely directed at golf putters that satisfy the Rules of Golf and that are therefore usable in tournament play. Hence, devices with concave impact surfaces are of no interest to the present case. Of interest is a putter with legitimate convex surfaces, as taught by Barr in U.S. Pat. No. 3,989,257. Barr provides an impact surface defined by intersecting horizontal and vertical ellipsoids, and claims that this surface is well suited to compensate for minute movements of a golfer's wrists during putting.

Other known designs, such as that taught by Witherspoon in U.S. Pat. No. 3,759,527, provide for golf clubs with convexly curved striking faces that accentuate the effects of how the club is held and used. These devices cause any imperfect swing to result in a missed shot, and claim utility only as training aids. Such devices are of no interest to the present case.

SUMMARY AND OBJECTIVES OF THE INVENTION

The present invention provides a golf putter with an optimized cylindrical face. The shape of the face of the putter of the present invention ensures that a ball will be stroked with a desireable over-spin. The preferred device retains much of a flat-faced putter's immunity to small variations in the height of a swing as well as to deviations from holding the axis of the club head parallel to the putting surface. Thus, it provides the advantages taught in the inventor's previous patent U.S. Pat. No. 4,881,739, while avoiding disadvantages inadvertently included in that apparatus.

Thus, it is an object of the invention to provide a golf putter that ensures over-spin and that also performs comparably to a flat-faced putter if a stroke is made with the bottom of the putter head lifted above a position of grazing incidence with the putting surface.

It is also an object of the invention to provide a cylindrically-faced golf putter that performs comparably to a flat-faced putter if a stroke is made with the axis of the putter head skewed to the putting surface.

It is a specific object of the invention to provide a golf putter that allows the user to stroke a ball along an intended line of roll, even if the user holds the club so as to have the heel of the club head below the toe of the club head.

It is a further specific object of the invention to provide a golf putter that allows the user to stroke a ball along an intended line of roll, even if the user holds the club so as to have the toe of the club head below the heel of the club head.

DESCRIPTION OF THE DRAWING

FIG. 2*a* illustrates an idealized stroke where the bottom of the head of the putter is slightly elevated above the putting surface.

FIG. 2*b* shows a putter head raised above the playing surface by less than the radius of the golf ball.

FIG. 2*c* shows a putter head raised above the playing surface by an amount equal to the radius of the golf ball.

FIG. 2*d* shows a putter head raised above the playing surface by an amount greater than the radius of the golf ball, but less than the diameter of the golf ball.

FIG. 2*e* shows a putter head raised above the playing surface by an amount equal to the diameter of the golf ball.

FIG. 3*a* illustrates an idealized stroke where the bottom of the head of the putter is slightly elevated above the putting surface.

FIG. 3*b* shows a putter head raised above the playing surface by less than the diameter of the golf ball.

FIG. 3*c* shows a putter head raised above the playing surface by an amount equal to the diameter of the golf ball.

DETAILED DESCRIPTION OF THE PREFERRED EMBODIMENT

Figure 1:
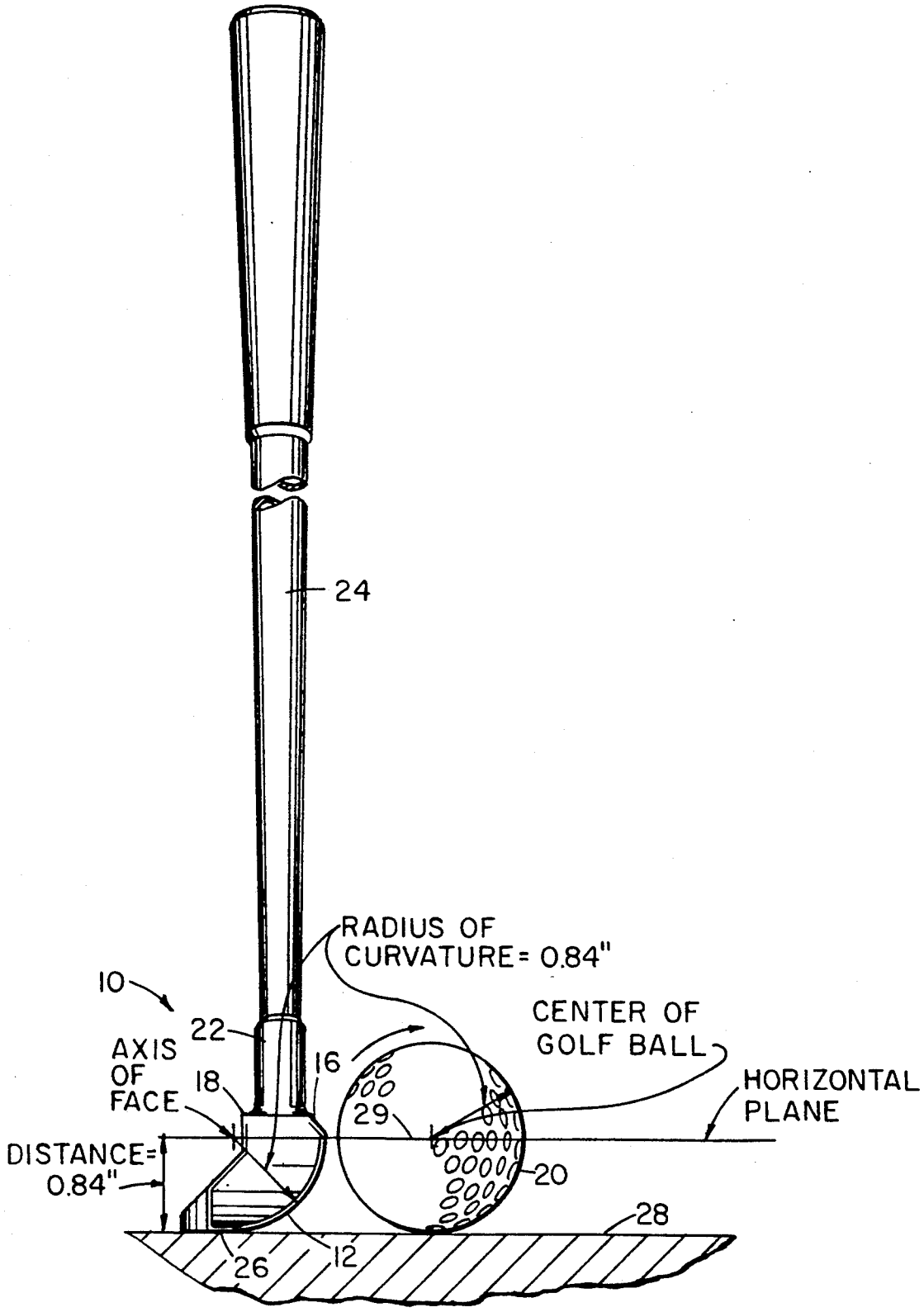
FIG. 1 of the drawing is a side elevational view of a prior art putter constructed according to the teaching of U.S. Pat. No. 4,881,739 and shown in playing relationship with a putter shaft, a golf ball, and a putting surface.

Turning now to FIG. 1 of the drawing one finds a putter 10 made according to the teaching of the inventor's prior patent U.S. Pat. No. 4,881,739 and having a putter surface or face 12 that is comprised of a 90 degree convex arc. The face 12 forms one half of the side of a right circular cylinder that has a radius equal to or slightly greater than that of a standard golf ball (0.84 inches).

The putter head 10 of U.S. Pat. No. 4,881,739 thus comprises a top surface or portion 18 formed with a generally upwardly directed hosel 22 for coupling the head 10 to a shaft 24 in a conventional manner. A bottom surface 26, or sole, of the head 10 is used to position the putter head 10 in a ball-striking position on a green or other putting surface 28. The ball-striking surface 12 is arcuate in cross-sectional shape, and is curved about an axis located in a horizontal plane, located essentially 0.84 inches from the sole 26 or as close as possible thereto, between the top portion and the sole 26. The radius of curvature of the ball-striking face was chosen to be between 0.84 and 1.12 inches. Since the club head should be raised slightly above the putting surface in order to putt without interference from the putting surface (a separation between the sole 26 and the putting surface 28 of between one thirty-second and one sixteenth of an inch is often considered optimal), the axial horizontal plane will therefore be more than 0.84 inches above the putting surface during the stroke.

As taught in U.S. Pat. No. 4,881,739, the provision of a curved face 12 with a radius of curvature that is at least as large as the 0.84 inch radius of a golf ball ensures that the ball can not be struck at an upward angle. In other words, the point of contact between the ball-striking face 12 of the putter head 10 and the ball 20 must be above a horizontal plane 29 passing through the center of mass of the golf ball, so that the ball is thereby given an over-spin.

Needless to say, not all golf strokes will be made according to the idealized picture shown in FIG. 1. There are many methods by which a golfer may depart form an ideal stroke geometry, and golfers are accustomed to suffering missed putts caused by imperfect strokes. Conversely, it is desirable to consider the effect of departures from ideal stroking geometries so that one can provide apparatus that does not enhance problems associated with one sort of stroking imperfection while alleviating problems associated with another.

A common departure from ideal stroking geometry is caused by swinging too high or too low. A low swing causes the head of the putter to hit the green behind the ball and to rebound from the green in an unpredictable fashion. In an ideal swing the sole 26 of the putter head 10 of FIG. 1 is lifted off the putting surface 28 by a distance of 1–2 mm. It is instructive to consider a number of cases that depart from ideality only in that the club head is raised above the putting surface by varying amounts—i.e. a sequence of purely high swings.

Figure 2A:
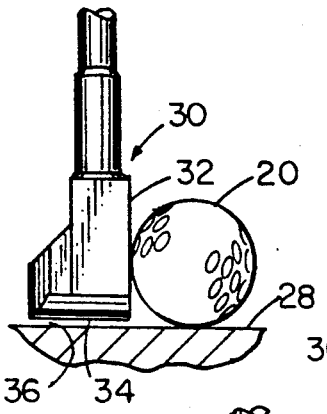
FIGS. 2*a*, 2*b*, 2*c*, 2D and 2E of the drawing comprise a set of schematic side elevational views of a flat-spaced putter head striking a golf ball wherein a different spacing between the putter head and the playing surface is shown in each figure.

The variety of situations presented by a high swing can be understood by turning to FIG. 2*a* of the drawing, where one finds a schematic representation of a rectangular parallelpiped putter head 30 that has a flat face 32 in contact with a ball 20. In FIG. 2*a* the putter head 30 is in an ideal position, with the sole 34 of the putter head 30 only slightly above the putting surface 28. In the geometry of FIG. 2*a*, the putter head 30 strikes the ball 20 at a height equal to its radius.

Figure 2B:
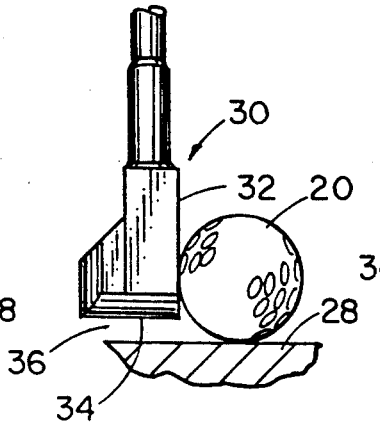
Figure 2C:
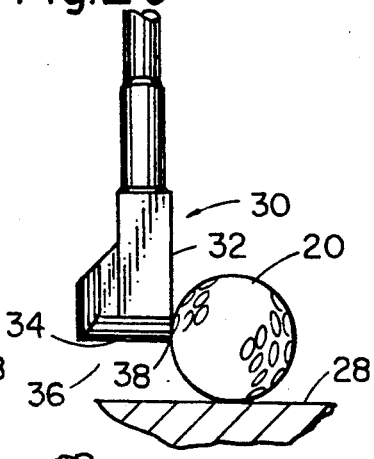
Figure 2D:
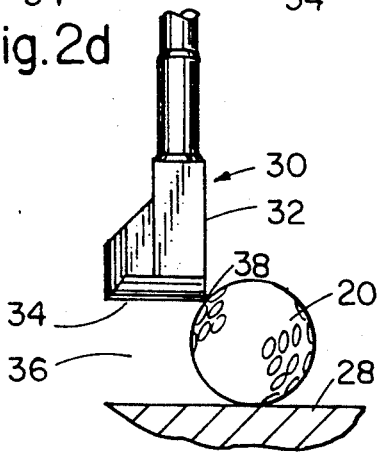
Figure 2E:
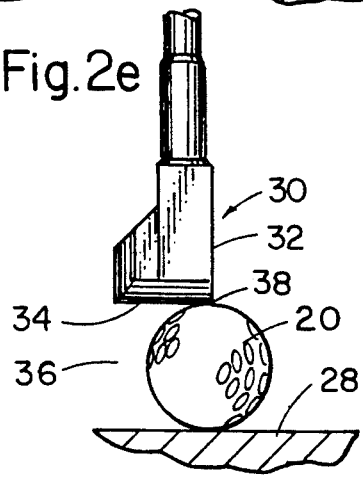

If the ideal swing of FIG. 2*a* is perturbed merely by swinging too high—i.e. by causing the sole 34 of putter head 30 to rise significantly above the putting surface 28 at the time that the ball is struck, but by maintaining the other aspects of the ideal swing geometry—one finds a sequence of events that is illustrated in FIGS. 2*b* through 2*e* of the drawing. FIG. 2*b* shows the putter head 30 lifted a distance 36, that is less than the radius of the golf ball, above the putting surface 28. In this case, the putter head 30 contacts the ball 20 at the same position as it did in FIG. 2*a*. As the putter head 30 continues to be lifted one reaches a critical geometry, shown in FIG. 2*c* of the drawing, where the distance 36 has increased so that the contact with the ball 20 is made with the bottom edge 38 of the putter head 30. As the putter head continues to rise above this critical point, as seen in FIG. 2*d*, the point of contact between the bottom edge 38 and the ball 20 rises above the center plane of the ball. As the process continues, one ultimately comes to the near-miss situation shown in FIG. 2*e*, where the sole 34 of the putter head 30 merely brushes the top of the ball 20.

Figure 3A:
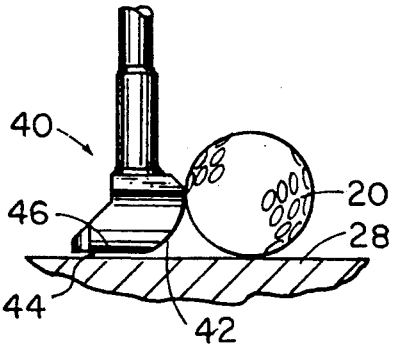
FIGS. 3*a*, 3*b* and 3*c* of the drawing comprise a set of schematic side elevational views of the cylindrical putter head taught in U.S. Pat. No. 4,881,739 striking a golf ball. As was the case in FIGS. 2*a*, 2*b*, 2*c*, 2*d* and 2*e* a different spacing between the putter head and the playing surface is shown in each of FIGS. 3A, 3*b*, and 3*c*.
Figure 3B:
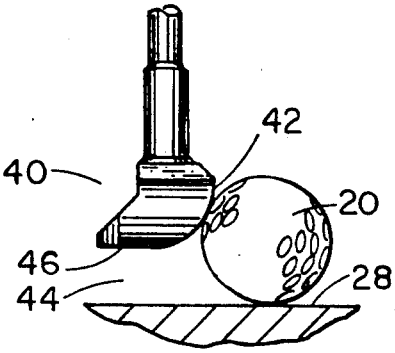
Figure 3C:
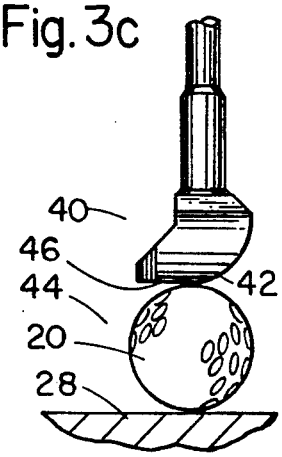

The corresponding situation for a putter with a cylindrical head 40 is shown in FIGS. 3*a*, 3*b* and 3*c*. Here, in keeping with the teaching of U.S. Pat. No. 4,881,739, the radius of the cylindrical face 42 is the same as that of the golf ball 20, so that in the ideal situation of 3*a*, the curved face 42 contacts the ball 20 slightly above its center of gravity. When one perturbs the ideal geometry by raising the putter head 40 by a small distance 44, the point of contact between the curved face 42 and the ball 20 rises as well. This is in contradistinction to the case of the flat-faced putter head 30 shown in FIGS. 2*a* through 2*e* where the point of contact with the ball did not rise until after the head had been raised a distance equal to the radius of the golf ball. The sequence of higher and higher swings terminates, as shown in FIG. 3*c*, when the putter head 40 has been raised a distance equal to the diameter of the golf ball and the sole 46 of the head 40 brushes across the top of the ball.

Figure 4:
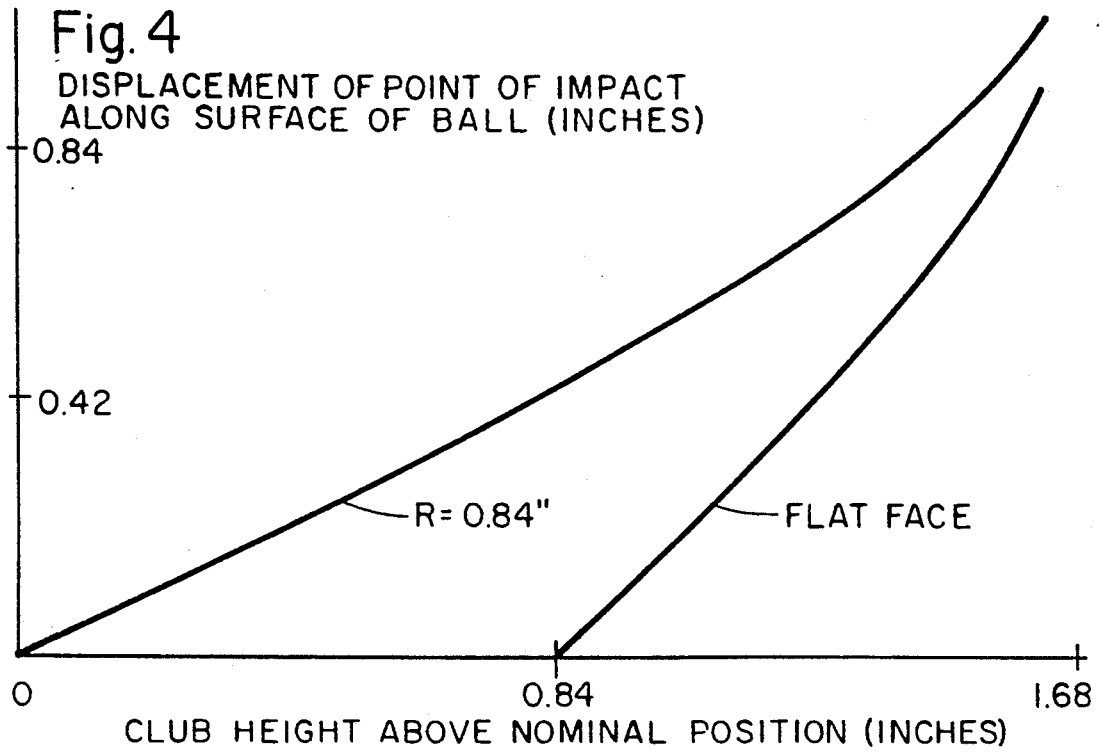
FIG. 4 of the drawing depicts how the impact point of a club on a ball moves along the surface of that ball as the club positions vary through the sequences shown in FIGS. 2*a*, 2*b*, 2*c*, 2*d* and 2*e* and FIGS. 3*a*, 3*b* and 3*c*.

The geometrical relationships shown for the simple perturbation of FIGS. 2A through 2*e* and 3*a* through 3*c* are summarized in FIG. 4. The club height above its ideal position is plotted along the x axis of FIG. 4 and the displacement of the point of contact (measured along the surface of the ball) between the ball and the putter heads 30, 40 is plotted on the y axis. The curve labelled "flat face" in FIG. 4 shows the results of the displacements indicated in FIGS. 2*a*, 2*b*, 2*c*, 2*d* and 2*e*. The "flat-face" curve shows no change in the contact point until the putter head 30 has been raised 0.84 inches (one golf ball radius). Subsequently, the contact point rises along an inverse sinusoidal curve which terminates at a displacement of 1.68 inches. Greater displacements result in a complete miss of the ball and are not represented in FIG. 4. The other curve of FIG. 4, labelled "R=0.84'", depicts the situation previously illustrated in FIGS. 3*a*, 3*b* and 3*c*. In this second case the contact point rises along an inverse sinusoidal curve as soon as the putter head 40 begins to be lifted from the putting surface 28.

The curves of FIG. 4 show both that a cylindrical putter face is superior in inducing over-spin, and that the degree of over-spin increases as the putter is raised. On the other hand, with a flat-faced putter the initial stages of lifting the putter sole above the putting surface are ineffective in increasing over-spin. Ensuring over-spin with the flat-faced putter thus requires an abnormally high swing.

Figure 5A:
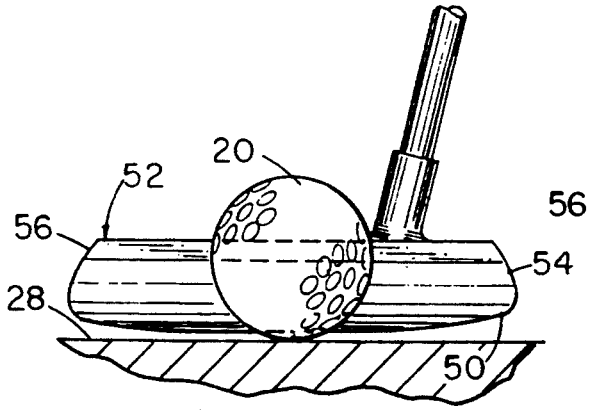
FIG. 5*a* presents a front elevational view of a golf ball and putter head where the axis of the putter head is parallel to the putting surface.
Figure 5B:
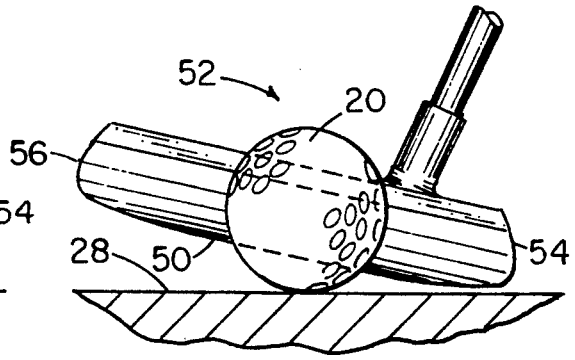
FIG. 5*b* presents a front elevational view of a golf ball and putter head where the putter head is positioned in a "heel down" attitude.
Figure 5C:
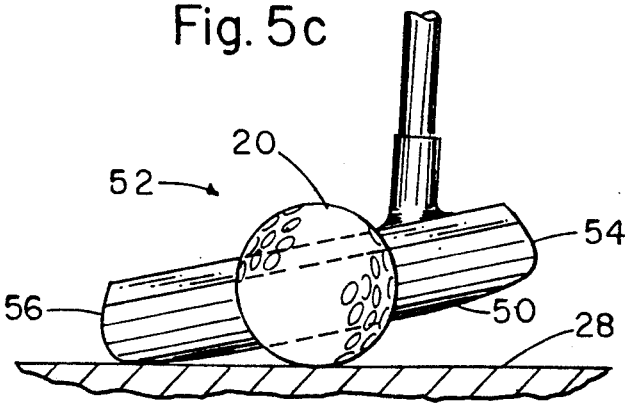
FIG. 5*c* presents a front elevational view of a golf ball and putter head where the putter head is positioned in a "toe down" attitude

Turning now to FIGS. 5*a*, 5*b* and 5*c* of the drawing, one finds another possible perturbation in putter head positions. In the ideal case, shown in FIG. 5*a*, the sole 50 of putter head 52 is parallel to putting surface 28. In some cases, as shown in FIG. 5*b*, the golfer may hold the putter so that the heel 54 of the putter head 52 is lower than the toe 56 ("toe high"). Alternately, as shown in FIG. 5*c*, a golfer may hold his putter so that the heel 54 of the putter head 51 is higher than the toe 56 ("heel high").

The situation shown in FIGS. 5*a*, 5*b* and 5*c* has significant similarities to the case discussed above with respect to FIGS. 2*a*, 2*b*, 2*c*, 2*d* and 2*e* and FIGS. 3*a*, 3*b*, and 3*c*. Where the putter sole was uniformly raised, rather than being tilted. As the heel 54 of the putter head 50 is lowered relative to the toe 56, the point of impact between the club face and the ball can move higher along the surface of the ball. Once again, if one considers a flat-faced putter, one finds that the initial stages of dropping the heel 54 produce no effect on the point of impact, but after a critical degree of tilt is attained the point of impact is altered. Some professional golfers have learned to putt well with a flat-faced putter held in a toe-high position, which has the effect of raising the point of impact above the center of gravity of the ball—i.e. which is advantageous in that it promotes over-spin. On the other hand, a putter with a cylindrical face experiences no initial period during which dropping the heel does not effect the point of impact. That is, for a cylindrical putter the point of impact moves as soon as the sole 50 of the putter begins to tilt away from the horizontal.

Although it is desireable for the club head to contact the ball above the ball's center of gravity in order to induce over-spin, too high a point of contact will cause the ball to 'hop' rather than to roll smoothly, and may cause the putt to be missed. The foregoing discussion of departures from an ideal stroke geometry (e.g. that of FIG. 1) leads one to expect that a cylindrical putter head may cause excessive over-spin and hopping if the stroking geometry deviates from the ideal.

This matter of deviation from ideal stroking geometry, especially that induced by intentionally adopting a toe-high or heel-high stroking position, was not initially appreciated by the inventor. Many golfers who used clubs made according to the teaching of his U.S. Pat. No. 4,881,739 reported significant improvement in their putting. Numerous observations of putts, made by both professional golfers and by amateur golfers covering a wide range of golfing ability, showed that although the putter of U.S. Pat. No. 4,881,739 usually produced superior results, its use was associated with occasional unpredictable putts. These studies were continued for several years before the inventor appreciated that the problem was being caused by variations in the point of impact, especially those caused when the golfer intentionally or unintentionally rotated his wrists to adopt a toe-high or heel-high position.

Thus, a new design was developed that sought both to ensure over-spin (e.g. by requiring that the radius of the putter face be at least as great as that of the ball), and to minimize deleterious effects brought about by a toe-high or heel-high stroking position. Turning again to FIG. 4 of the drawing, one can now consider the two curves shown there to be the limiting cases of useful putter face curvatures. The minimum curvature (R=0.84") is set by the requirement of providing over-spin on the putted ball—i.e. a radius of curvature less than the radius of the golf ball can lead to lofting the ball or making a putt with an initial backspin on the ball. The other limit occurs when the radius of curvature becomes infinite—i.e. for the flat-faced putter.

An extended experimental program was undertaken to determine the optimal radius of curvature. This program involved several hundred golfers with a wide range of abilities, a variety of putting surfaces (e.g. the Bermuda grasses that are commonly used in subtropical areas as well as the Bent grasses that are more commonly found in northern parts of the United States), and a number of different putter face radii ranging from 0.84 inches to about 6 inches. The results of these studies indicated that an optimal radius of curvature of the cylindrical ball-striking surface was approximately 4 inches.

Figure 6A:
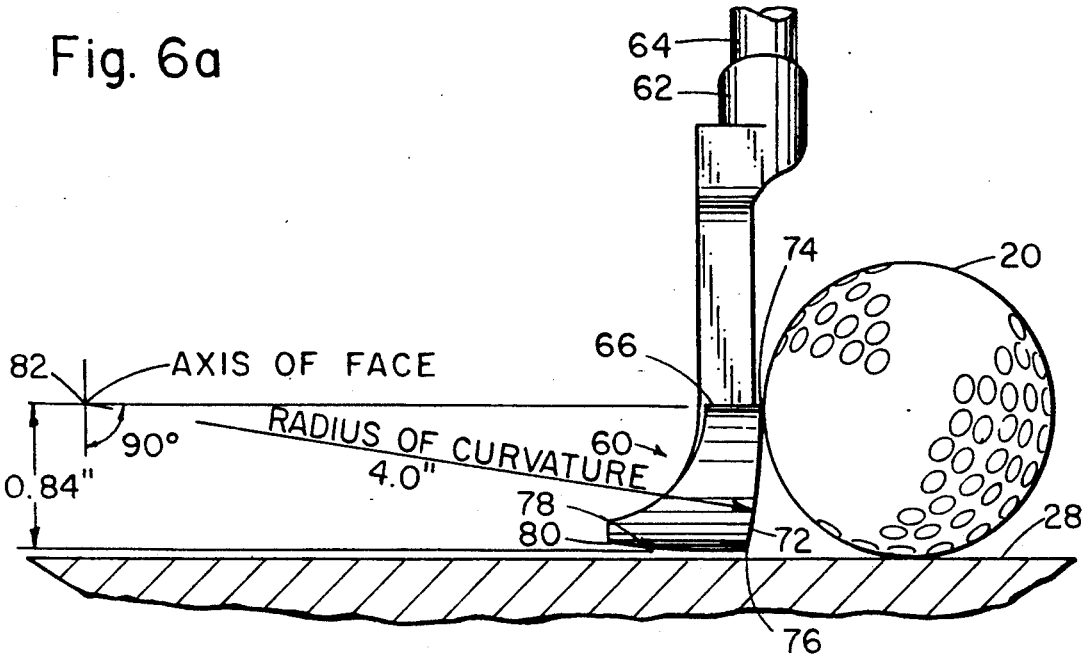
FIG. 6*a* is a side elevational view of the putter head of the invention, shown in playing relationship with a putter shaft, a golf ball, and a putting surface.
Figure 6B:
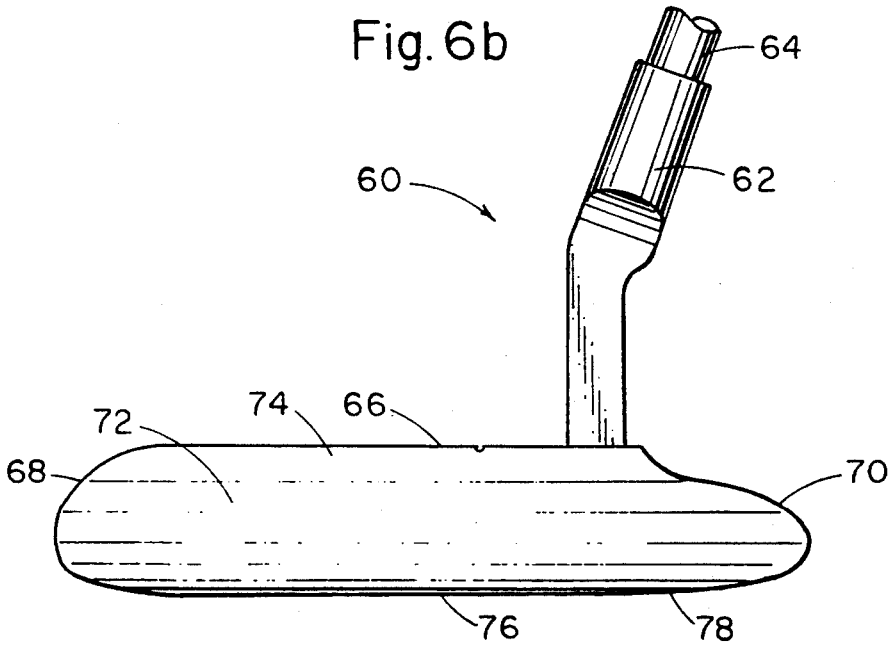
FIG. 6*b* is a front elevational view of the putter head of the invention.
Figure 6C:
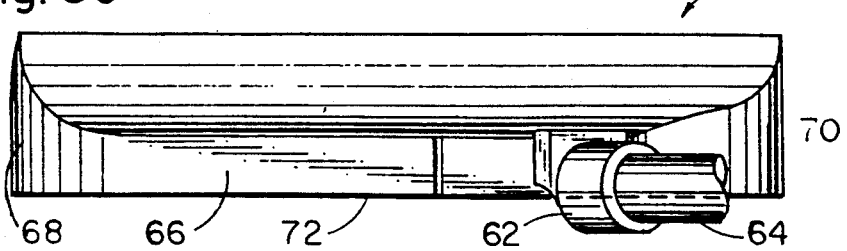
FIG. 6*c* is a top plan view of the putter head of the invention.

The club head of the invention, shown in FIGS. 6*a*, 6*b* and 6*c* of the drawing, has the same general appearance as the club head shown in FIGS. 1–3 of the inventor's earlier U.S. Pat. No. 4,881,739. The new putter head 60, shown in FIG. 6*a*, includes an upper portion formed with a generally upwardly directed hosel 62 for coupling the head to a shaft 64 in a conventional manner. The top surface 66, which is preferentially flat, extends generally from the toe 68 to the heel 70 of the putter head. The ball-striking surface 72 is arcuate in cross-sectional shape, and extends from a top leading edge 74 (formed by the intersection of the ball-striking surface 72 and the top surface 66) to a bottom leading edge 76 that is formed by the intersection of the ball-striking surface 72 and a central portion of the bottom, or sole, 78 of the putter head. The sole 78 may be a flat surface parallel to the top surface 66, but is preferentially slightly curved, as shown in FIG. 6*a*, so that the trailing edge 80 of the sole will clear the putting surface 28 if the sole's leading edge 76 clears that surface during a normal swing. As shown in FIG. 6*b*, the bottom surface 78 may also curve upward toward the toe 68 and the heel 70 of the putter head. The bottom leading edge 76 of the sole 78 is a straight line parallel to the top leading edge 74 in the central portion of the head, where it is intended that the ball be struck. The ball-striking surface 72 has a radius of curvature of about 4 inches about an axis 82 located in a plane that is parallel both to the top surface 66 and to the bottom leading edge 76 and that is spaced essentially 0.84 inches from the leading edge of the sole 76 or as close as possible thereto. Since the range of radii of curvature that the inventor's investigation showed to be useful ranged from about 2 to about 6 inches, the axis of curvature 82 (as shown in FIG. 6*a*) is located external to the putter head itself, as the thickness of the head (e.g. from the leading edge 76 to the trailing edge 80 of the sole 78) is commonly on the order of 1 inch.

Although the present invention has been described with respect to several embodiments, many alterations and modifications thereof may be made without departing from the invention. Accordingly, it is intended that all such alterations and modifications be considered as within the spirit and scope of the invention as defined in the appended claims.

I claim:

1. A golf putter comprising, in combination, a shaft having a grip on its upper end, and an elongated putter head having a heel area and a toe area, said putter head being formed with a top portion including a flat top surface and means for coupling said shaft to said head, a bottom portion having a centrally located bottom leading edge parallel to said top surface, and a cylindrical ball-striking face extending downwards from said top portion to said bottom leading edge and laterally from said heel area to said toe area and having a radius of curvature of at least 2 inches and at most 6 inches about a horizontal axis lying in a plane parallel to said top surface and intermediate between said top surface and said bottom leading edge, wherein said plane is spaced at least 0.84 inches from said bottom leading edge.

2. A putter of claim 1 wherein said radius of curvature is 4.0 inches.

3. A putter of claim 1 wherein said plane is spaced 0.84 inches from said bottom leading edge.

4. A putter of claim 1 wherein said plane is spaced 0.84 inches from said bottom leading edge and said radius of curvature is 4.0 inches.

* * * * *